United States Patent [19]

Koishi et al.

[11] Patent Number: 4,942,293

[45] Date of Patent: Jul. 17, 1990

[54] OPTICAL WAVEFORM OBSERVING APPARATUS

[75] Inventors: Musubu Koishi; Yutaka Tsuchiya; Tomoyoshi Hara; Kenji Suzuki, all of Shizuoka, Japan

[73] Assignee: Hamamatsu Photonics Kabushiki Kaisha, Shizuoka, Japan

[21] Appl. No.: 291,822

[22] Filed: Dec. 29, 1988

[51] Int. Cl.[5] ..... H01J 31/50

[52] U.S. Cl. ..... 250/213 VT; 313/529

[58] Field of Search ..... 250/213 VT; 313/529, 313/537

[56] References Cited

U.S. PATENT DOCUMENTS 4,740,685 4/1988 Koishi ..... 250/213 VT 4,801,796 1/1989 Kinoshita et al. ..... 313/529

*Primary Examiner*—David C. Nelms

*Assistant Examiner*—Khaled Shami

*Attorney, Agent, or Firm*—Finnegan, Henderson, Farabow, Garrett and Dunner

[57] ABSTRACT

Optical waveform observing apparatus including a sampling streak tube to which is applied an incident light beam having a waveform of repetitive frequency to be observed. An electron beam corresponding to the incident light beam is repetitively deflected in the streak tube, in response to a repetitive deflecting trigger signal, to sample the electron beam. The deflecting trigger signal is generated by a time sweep circuit that stepwise delays the occurrence of that signal when the sampling operation is carried out a predetermined number of times. An integration circuit integrates the output of the streak tube for the predetermined number of sampling operations for a sampling time and is then reset to begin integrating the streak tube output for the predetermined number of sampling operations for a next sampling time. The integration circuit output is digitized and displayed.

18 Claims, 7 Drawing Sheets

OPTICAL WAVEFORM OBSERVING APPARATUS

BACKGROUND OF THE INVENTION

1. Field of the Invention

The invention relates to optical waveform observing apparatus for observing the waveform of an optical pulse having a predetermined repetitive frequency.

2. Description of the Prior Art

One example of conventional means for observing the waveform of an optical pulse having a constant repetitive frequency is optical waveform observing apparatus of the type including a streak tube used to convert the variation with time of an optical pulse into a luminance distribution, such as a streak image on a phosphor screen.

FIG. 5 is a block diagram showing the arrangement of a conventional optical waveform observing apparatus as disclosed in U.S. Pat. No. 4,645,918. In that apparatus, a hematoporphyrin derivative 104 is excited with a pulsed light beam repetitively outputted by a dye laser oscillator 101, to emit fluorescence having a waveform that is observed with a streak tube 130. Streak tube 130, as shown in FIG. 5, comprises a photocathode 131 to which fluorescence is applied, an accelerating electrode 135 for accelerating an electron beam output by photocathode 131, a focusing electrode 136 for focusing the electron beam accelerated by accelerating electrode 135, an aperture electrode 137, deflecting electrodes 133 for deflecting in a sweep mode the electron beam that has been focused by focusing electrode 136 and passed through aperture electrode 137, a microchannel plate 132 for multiplying the electron beam thus deflected, and a phosphor screen 134 to which the output electron beam of microchannel plate 132 is applied.

The pulsed light beam repetitively outputted by dye laser oscillator 101 is divided into two pulsed light beams by a beam splitter 102. One of the two pulsed light beams excites the hematoporphyrin derivative 104 repetitively, so that the fluorescence emitted by the derivative 104 is applied through an optical system 16 to the photocathode 131 of the streak tube 130 at a certain repetitive frequency. The other pulsed light beam is applied to a photodiode 105 to form an electrical signal TR for a predetermined deflecting voltage that is applied to the deflecting electrodes 133 in the streak tube 130. More specifically, the pulsed light beam is subjected to photo-electric conversion b.y the photodiode 105 to form the electrical signal TR. The electrical signal TR, being delayed by a time sweep circuit 107 under the control of a control circuit 110, is converted into a deflecting trigger signal that is applied to a deflecting circuit 108. Circuit 108 in turn produces a deflecting voltage in synchronism with the deflecting trigger signal.

With respect to the streak tube 130, the output electron beam of the photocathode 131 is deflected by the deflecting voltage applied across the deflecting electrodes 133 in the sweep mode, so that the variation with time of the fluorescence applied to the photocathode 131 is converted into a spatial luminance distribution on the phosphor screen 134. i.e., it is observed as a streak image. In the optical waveform observing apparatus of FIG. 5, the light of the luminance distribution on the phosphor screen 134, i.e., the light of the streak image, is applied through a lens 118 to a sampling board 111 with a slit 109, so that it is sampled by the slit 109 to provide a sampling waveform. The sampling waveform is applied to a photomultiplier 112 that subjects it to photo-electric conversion and multiplication. The output of the photomultiplier 112 is applied through an amplifier 113 to a display unit 114.

The operation of the optical waveform observing apparatus thus organized will be described with reference to time charts shown in parts (a) through (e) of FIG. 6.

In response to the pulsed light beam repetitively outputted by the dye laser oscillator 101, the hematoporphyrin derivative 104 outputs fluorescence with a repetitive period. This is indicated in part (a) of FIG. 6 which shows the waveform of an incident light beam IN that is applied to the photocathode 131 of the streak tube 130. Also, in response to the pulsed light beam of the dye laser oscillator 101, the photodiode 105 outputs the electrical trigger signal TR as shown in part (b) of FIG. 6. As is apparent from parts (a) and (b) of FIG. 6, the electrical trigger signal TR is completely synchronized with the incident light beam IN. The electrical trigger signal TR is gradually delayed by the time sweep circuit 107 as shown in part (c) of FIG. 6 and converted into the deflecting trigger signal. That is, under the control of control circuit 110, the time sweep circuit 107 forms a sampling sequence type deflecting trigger signal that allows a sampling operation at a sampling time, the next sampling operation at the next sampling time, and so on. As shown in part (c) of FIG. 6, at the n−th sampling time, the deflecting trigger signal TRl is delayed by a period of time n·t from the trigger signal TR; at the (n+1)-th sampling time, the deflecting trigger signal TR2 is delayed by a period of time (n+1)·t; at the (n+2)−th sampling time, the deflecting trigger signal TR3 is delayed by a period of time (n+2)·t; and so forth, where t is the unitary delay time of the deflecting trigger signal.

When the deflecting trigger signals are applied to the deflecting circuit 108, the deflecting circuit produces the deflecting voltage V as shown in part (d) of FIG. 6. As is apparent from part (d) of FIG. 6, the deflecting voltage V is maintained at a potential $V_m$ when it is not used to deflect the output electron beam of ther photocathode 131. However, when the deflecting trigger signal is applied to the deflecting circuit 108, the deflecting voltage drops to a potential $-V_m$ substantially with a ramp characteristic, to deflect the electron beam. Whenever the deflecting voltage is decreased in the above-described manner, the electron beam is deflected downwardly, as a result of which it is observed as steak images FG1, FG2, FG3, . . . at the sampling times as shown in part (e) of FIG.6. As a result, the variation in intensity of the incident light beam IN can be observed as a luminance distribution.

As is seen from parts (a) and (b) of FIG. 6, the streak images FG1, FG2, FG3, . . . reflect the respective incident light beams IN. However, the streak images are shifted in phase from one another because the deflecting voltages as the sampling times are shifted in phase from one another. When, during the electron beam deflecting operation, the deflecting voltage is near zero (0) volts, the electron beam is not deflected, and reaches the central portion and emits a light beam at the central portion of the phosphor screen. Most of the light beam thus reached passes through the slit 109 of the sampling board 111, so that it is detected as a sampling signal by the photomultiplier 112. That is, referring to part (e) of FIG. 6, at the respective n−th, (n+1)−th and (n+2)−th sampling times, sampling signals Pl, P2 and P3 are extracted by the slit 109 of the sampling board 111 and detected by the photomultiplier 112.

The sampling signals P1, P2, P3, . . . are detected in a time-series mode and are arranged, as a result of which one pulse waveform of the incident light beam "IN" can be observed with a predetermined time resolution.

In the case of FIG. 5, the sampling board 111 with the slit 109 is provided outside the streak tube 130. However, as shown in FIG. 7, the sampling board may be arranged between the microchannel plate 132 and the phosphor screen 134. In a streak tube 150 shown in FIG. 7, a sampling electrode 151 is provided therein and held at the same potential as the phosphor screen 134. The streak tube having the sampling electrode inside it is generally referred to as "a sampling streak tube." With respect to the sampling streak tube, the sampling waveform can be extracted before the electron beam reaches the phosphor screen 134. Therefore, unlike the apparatus shown in FIG. 5 in which the electron beam is kept applied to the phosphor, screen 134 throughout the whole period, in an optical waveform observing apparatus with the sampling streak tube, the necessary electron beam is applied only to the central portion of the phosphor screen 134, and only a part of the luminance distribution is applied to the photomultiplier 112. As a result, the sampling waveforms detected are less affected by the background noises of the phosphor screen.

In the streak tube 130 shown in FIG. 5 or in the sampling steak tube 150 shown in FIG. 7, the accelerating electrode 135 is a circular mesh accelerating electrode and, therefore, the electron beam passing through the accelerating electrode 135 includes background noises. The mesh opening percentage of the accelerating electrode 135 is generally 60%. As shown in part (a) of FIG. 8, about 40% of the incident light beam which, not being subjected to photo-electric conversion by photocathode 131, has passed therethrough, is scattered by the mesh material, to form scattered light beams DF. The scattered light beams DF are applied to photocathode 131 from behind and cause the photocathode to emit photoelectrons BG that represent the background noises. Part (b) of FIG. 8 shows the density distribution of the electrons that reach the sampling electrode 151 in the streak tube 150. As is apparent from part (b) of FIG. 8 in the case where the accelerating electrode 135 is a mesh electrode, the electron density distribution $\rho$ includes a signal electron density distribution $\rho_o$ and a scattered light beams photoelectron density distribution $\rho_e$. The latter density distribution $\rho_e$ represents the background noises and lowers the sampling waveform observation accuracy. As seen from the density distribution $\rho_2$, the photoelectrons BG, due to the scattered light beams, are greatest in number at the central portion of the phosphor screen to which the incident light beam is applied, and fewer in number towards the periphery of the phosphor screen. The scattering electrons around the incident light beam thus lowers the measuring accuracy. As a result, it is difficult to accurately measure a light pulse waveform with high time resolution, since background noises due to the scattered light beams DF are produced before and after the measured light pulse.

The background noises as represented by the density distribution $\rho_e$ are spread over a wide range. As a result, during a non-sweep standby period, while the incident light beam is applied to the photocathode 131, the noise electrons of density distribution $\rho_e$ will be sampled with high probability. Accordingly, those noise electrons should be eliminated. For this purpose, in the conventional optical waveform observing apparatus, the deflecting voltage V applied by the deflecting circuit 108 is made large in amplitude and through rate (voltage/-time). This can lower the probability that, during electron beam deflection, the photoelectrons attributable to the scattered light beams are sampled. As the amplitude of the deflecting voltage V is made large, the potential $V_m$ of the deflecting voltage V is large during the non-sweep standby period . Therefore, even if the incident light beam is applied to the photocathode 131, the signal electrons attributable to the incident light beam are greatly deflected by the deflecting electrodes 133, thus reaching a peripheral portion of the phosphor screen 134 that is remote from the central portion. As a result, even if the density distribution $\rho_e$ of the photoelectrons due to the scattered light beams is spread over a wide range, the probability that these photoelectrons reach the central portion of the phosphor screen 134 is small and accordingly, their effect on the sampling waveform is eliminated.

With respect to the sampling streak tube 150 shown in FIG. 7, the potential $V_m$ of the deflecting voltage V is made large enough so that, during the non-sweep period when the electron beam is not undergoing deflection, the electron beam reaches a portion of the sampling electrode 151 that is remote from the slit. Accordingly, in this case also, the sampling waveform is protected from being affected by the photoelectrons caused by the scattered light beams. In practice, the potentials $V_m$ and $-V_m$ of the deflecting voltage V are about +1 KV and −1 KV, respectively.

In the optical waveform observing apparatus in which the waveform of an incident light beam is observed by sampling, an aperture time $\Delta t$ in which the sampling waveform is extracted is determined by a sweeping velocity $V_t$ at which the electron beam emitted by the photocathode 131 in response to the incident light beam is deflected to sweep across the slit of the sampling electrode, a diameter u of the electron beam, and a slit width w of sampling electrode 151. The aperture time $\Delta t$ corresponds to the time resolution and is represented by the following equation (1):

$$\Delta t=\sqrt{(u^2+w^2)/v_t} \quad (1)$$

The sweeping velocity $v_t$ can be represented by the following equation (2):

$$v_t=S\times T \quad (2)$$

where S is the deflection sensitivity (cm/V) of sampling streak tube 150, and T is the through rate (V/sec) of the deflecting voltage.

As is apparent from equation (1) and (2), the aperture time $\Delta t$ is decreased as the deflection sensitivity S and-/or the deflecting voltage through rate T increase, with the result that the time resolution is improved.

However, the conventional optical waveform observing apparatus exhibits problems when the distance between the pair of deflecting electrodes 133 is decreased for improvement of the deflection sensitivity S. Since the deflecting voltage $v_m$ has been made large in amplitude for the reasons described above, the greatly deflected electron beam will, during the non-sweep period, strike against and be reflected by the deflecting electrodes. The reflected beam will travel to the central portion of the phosphor screen 134. Accordingly, in the conventional optical waveform observing apparatus, it is impossible to greatly reduce the distance between the pair of deflecting electrodes 133. That is, the improvement to the deflection sensitivity S is limited. As a result, it is impossible to obtain a time resolution on the order of several pico seconds and, further, it is also impossible to increase the repetitive frequency of the deflection.

The above-described difficulties are eliminated by an apparatus disclosed in Japanese Patent Application NO. 163535/87 entitled "Optical Waveform Observing Apparatus." U.S. patent application Ser. NO. 291,893 was filed on 12/29/88. The apparatus disclosed in these applications is as shown in FIG. 9.

In the optical waveform observing apparatus of FIG. 9, a sampling streak tube 1 comprises a photocathode 131 to which an incident light beam is applied, an accelerating electrode 2 for accelerating the electron beam emitted from the photocathode, deflecting electrodes 133 for deflecting in a predetermined direction the electron beam passed through accelerating electrode 2, a sampling electrode 4 for sampling the deflected electron beam, and phosphor screen 134 for detecting the electron beam sampled by a slit 5 of a sampling electrode 4. Accelerating electrode 2 is in the form of a plate having an opening 3. Blanking deflecting electrodes 21 are interposed between the sampling electrode 4 and the deflecting electrodes 133 so that during a flyback period of the deflecting electrodes 133, the electron beam may not be sampled. The incident light beam applied to the photocathode 131 of the sampling streak tube 1 is a light pulse having a repetitive frequency whose waveform is to be observed. The light pulse is outputted by a pulsed light source 10 and it is applied through a beam splitter 102, optical delay means 11 and input optical system 12 to photocathode 131.

In similar fashion to the beam splitter in the conventional optical waveform observing apparatus, the beam splitter 102 splits the incident light beam outputted by a pulsed light source 10 into two parts, one of which is applied to a photodiode 105, where it is converted into a deflecting trigger signal TR. Also in similar fashion to the conventional apparatus, the deflecting trigger signal TR is applied to a time sweep circuit 107, where it is gradually delayed so that the sampling operation is carried out once every sampling time as was described above. The deflecting trigger signal TR thus processed is applied to a deflecting circuit 13 and a blanking deflecting circuit 22.

A Photodiode 105 is used to form the electrical trigger signal TR by photo-electric conversion. However, a drive signal for the pulsed light source 10 may be employed as the electrical trigger signal TR by operating a switch 14.

In the optical waveform observing apparatus constructed as illustrated in FIG. 9, the plate-shaped accelerating electrode 2 with opening 3 is employed and, therefore, the photoelectrons due to the scattered light beams are blocked by the solid (not opened) portion of the accelerating electrode. As a result, the probability that the photoelectrons are mixed with the signal electrons, thus providing background noises, is greatly reduced. Therefore, when the amplitude of the deflecting voltage applied across deflecting electrodes 133 is reduced, the background noises caused by the incident light beam applied during the non-sweep period are quite small. Accordingly, the probability that the background noises are sampled by a slit 5 of the sampling electrode 4 is reduced. Thus, the deflecting voltage applied to the deflecting electrodes 133 can be made small in amplitude and the distance between the deflecting electrodes 133 can be decreased, as a result of which the deflection sensitivity is improved and the deflecting repetitive frequency can be increased. Further, since the deflecting voltage may be small in amplitude, a switching element or a drive element in the deflecting circuit can have a relatively low withstand voltage. Accordingly, the deflecting circuit 13 can be constructed using high frequency transistors or step recovery diodes, so that a high repetitive deflection frequency, e.g. on the order of 4 MHz, can be readily achieved.

In the case of providing a high repetitive deflection frequency, such as on the order of 4 MHz, a corresponding repetitive sampling rate, such as 4 MHz, is achieved. In this case, with reference to parts (a) through (e) of FIG. 6, the corresponding repetitive period $T_o$ is 250 nano-seconds.

The phenomenon called "afterglow" occurs on the phosphor screen 134 of the sampling streak tube. The time of attention of the afterglow depends on the material forming the phosphor screen. However, it is generally much longer than 250 nano-seconds, being in the range of from several tens of micro-seconds to several hundreds of micro-seconds. If, in operating the optical waveform observing apparatus of FIG. 9 according to time charts such as illustrated in parts (a) through (e) of FIG. 6, the repetitive period To is so reduced that, before a current sampling operation at a current sampling time is completed, the next sampling operation at the next sampling time is started, then, although the signal processing speed may be increased, the observation accuracy is reduced because of the effect of afterglow. Therefore, the optical waveform observing apparatus of FIG. 9, in which the deflecting trigger signals are successively changed in delay time, must operate such that the next sampling operation is not started until the afterglow of the phosphor screen caused by the current sampling operation at the current sampling time is sufficiently attenuated, in order to maintain high observation accuracy. Thus, even if the deflecting circuit is designed to permit a relatively high repetitive deflection, it is difficult to reduce the repetitive period $T_o$ substantially to about 250 nano-seconds because of the afterglow of the phosphor screen 134. That is, in the case where one sampling sequence consists of N sampling times and the sampling sequence is repeated M times, the total signal processing time is equal to $N \times M \times T_o$. Since the repetitive period of the sampling times cannot be substantially decreased because of the above-described afterglow problem, the possible reduction of the total signal processing time is limited.

SUMMARY OF THE INVENTION

An object of the invention is to provide an optical waveform observing apparatus with which an optical waveform can be observed both quickly and accurately and without adverse affect due to the attenuation of the afterglow of the phosphor screen.

To achieve the above and other objects and in accordance with the purpose of the invention, as embodied and described herein, the invention comprises optical waveform observing apparatus including a sampling streak tube for observing a waveform of an incident light beam having a repetitive frequency, the streak tube including means responsive to a repetitive deflecting trigger signal for deflecting in a sweep mode an electron beam corresponding to the incident light beam so that the electron beam can be sampled. The apparatus comprises electrical trigger signal means for generating an electrical trigger signal in synchronism with the repetitive frequency of the incident light beam, time sweep means, operatively coupled to the trigger signal means, for stepwise delaying by a predetermined time period the electrical trigger signal to provide the deflecting trigger signal, the time sweep means effecting the stepwise delay in the deflecting trigger signal whenever the sampling operation is carried out a predetermined number of times, and integration means for integrating sampling results, outputted by the streak tube, of the sampling operations carried out the predetermined number of times and providing a corresponding integrated, sampling result.

The accompanying drawings, which are incorporated in and constitute a part of this specification, illustrate embodiments of the invention and together with the description, serve to explain the principles of the invention.

Figure 3:
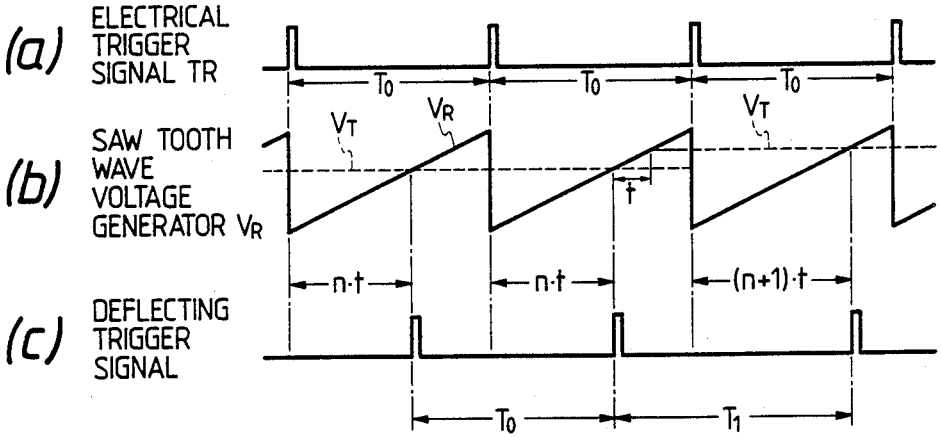
Figure 4:
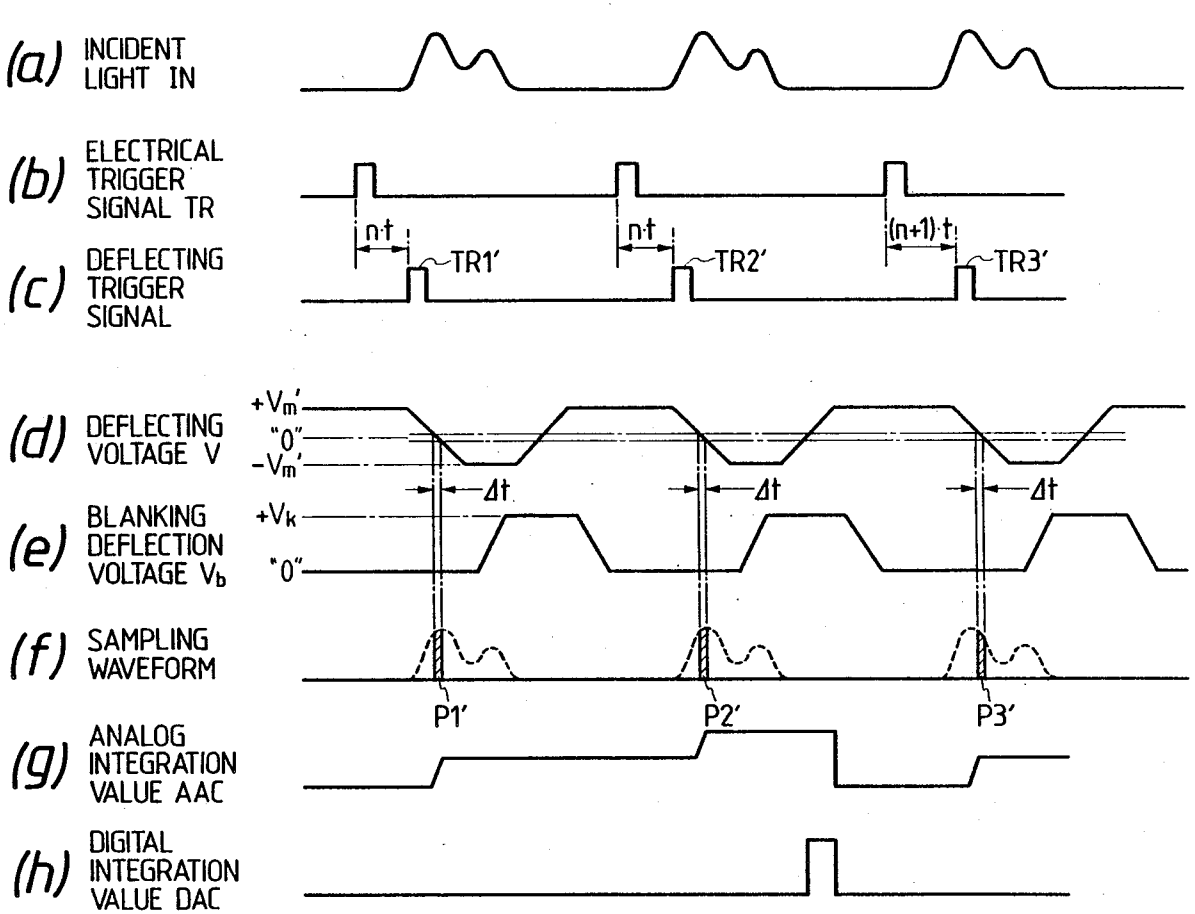
Figure 5:
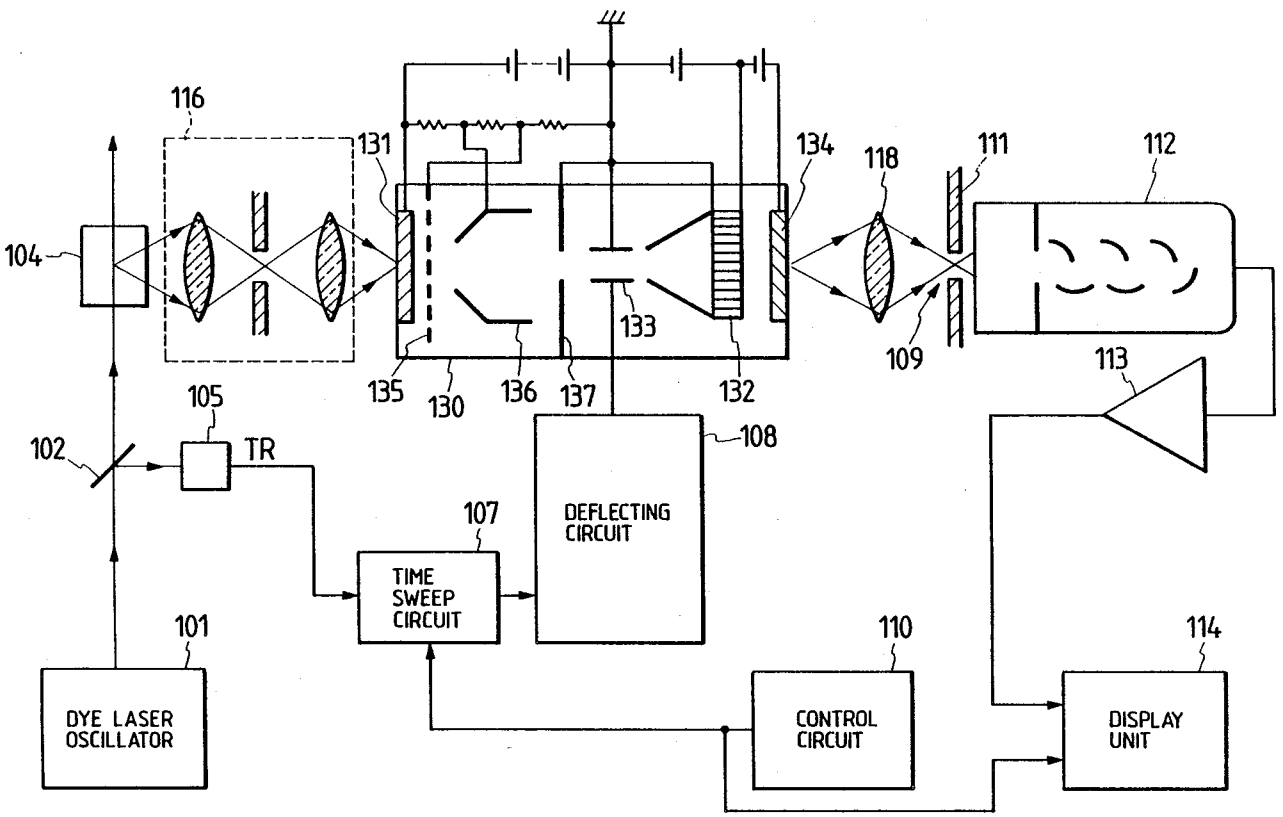
Figure 6:
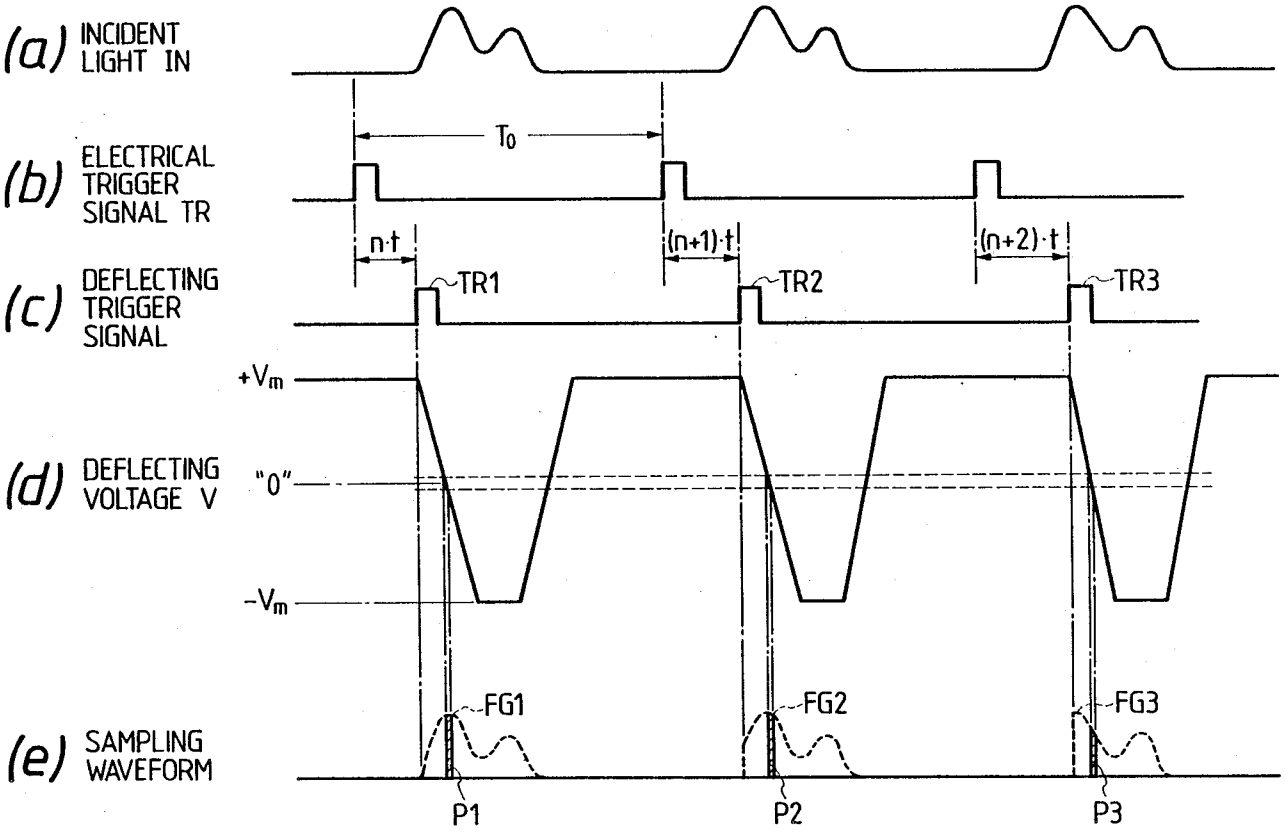
Figure 7:
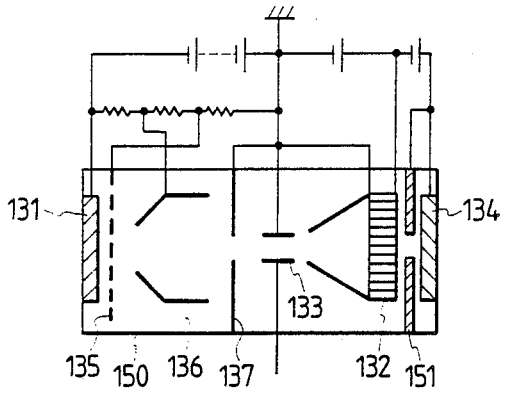
Figure 8A:
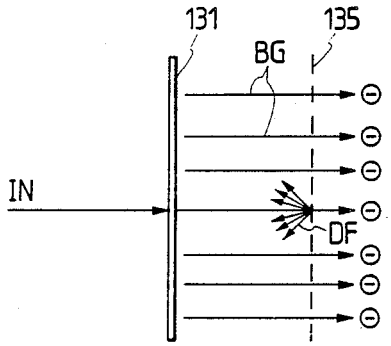
Figure 8B:
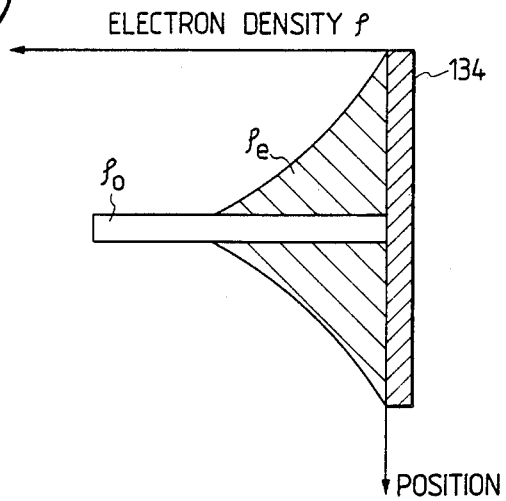
Figure 9:
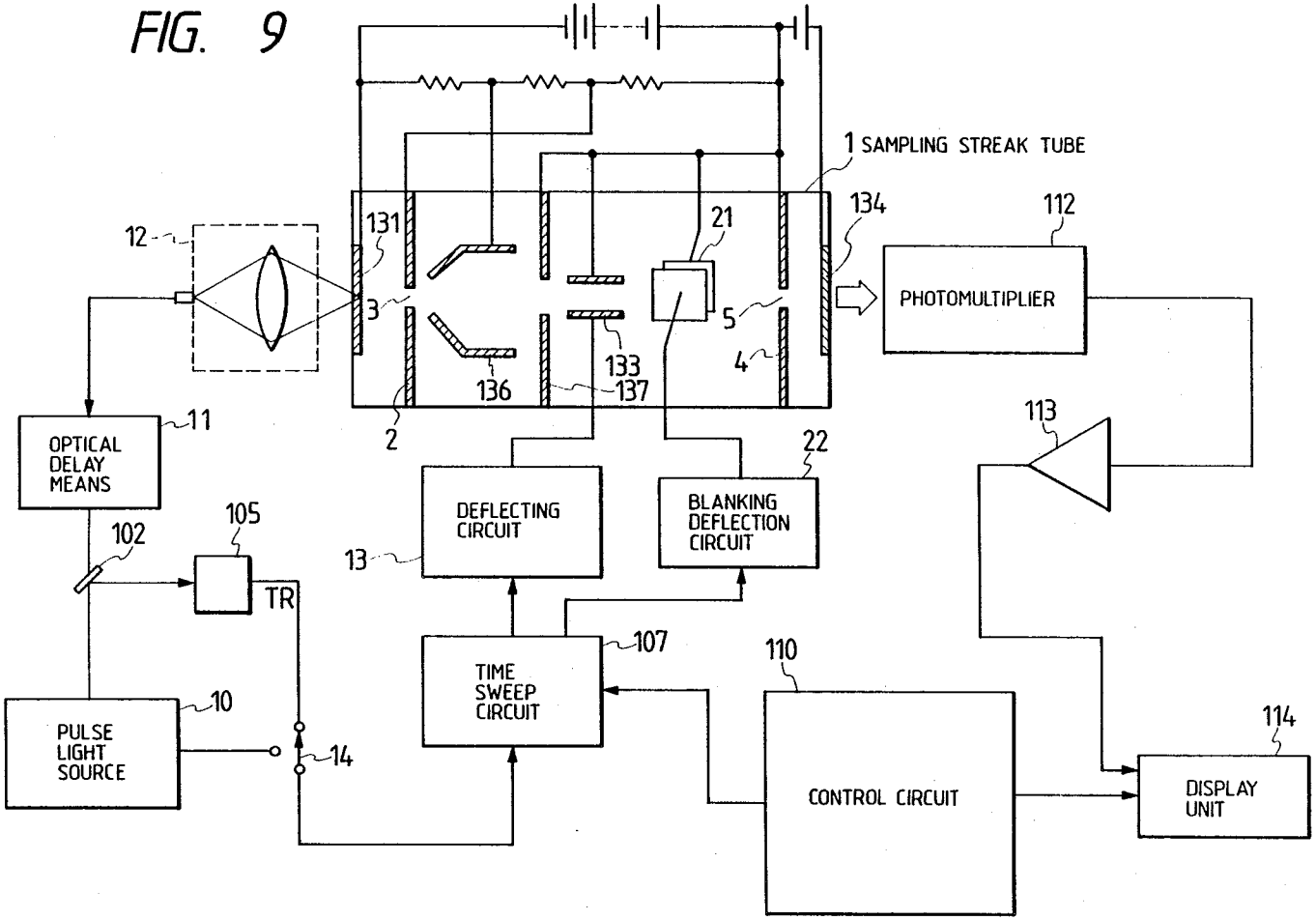

Parts (a), (b) and (c) of FIG. 3 are time charts, descriptive of the operation of the time sweep circuit, respectively showing electrical trigger signals, a saw tooth wave voltage and deflecting trigger signals;

parts (a) to (n) of FIG. 4 are time charts respectively showing incident light beams "IN", electrical trigger signals TR, deflecting trigger signals, a deflecting voltage V, a blanking deflecting voltage $V_b$, sampling waveforms, an analog integration value AAC and a digital integration value DAC;

FIG. 5 is a diagram showing the arrangement of a conventional optical waveform observing apparatus;

Parts (a) to (e), of FIG. 6 are time charts respectively showing incident light beams IN, electrical trigger signals TR, deflecting trigger signals, a deflecting voltage V and sampling waveforms;

FIG. 7 is a diagram showing the structure of a conventional sampling streak tube;

Parts (a) and (b) of FIG. 8 are., respectively, an illustration of the interception of photoelectrons due to scattered light beams in the case where a mesh-shaped accelerating electrode is employed, and an electron density distribution diagram for a sampling electrode in the same case; and FIG. 9 is a diagram showing the arrangement of an optical waveform observing apparatus.

DESCRIPTION OF THE PREFERRED EMBODIMENT

Figure 1:
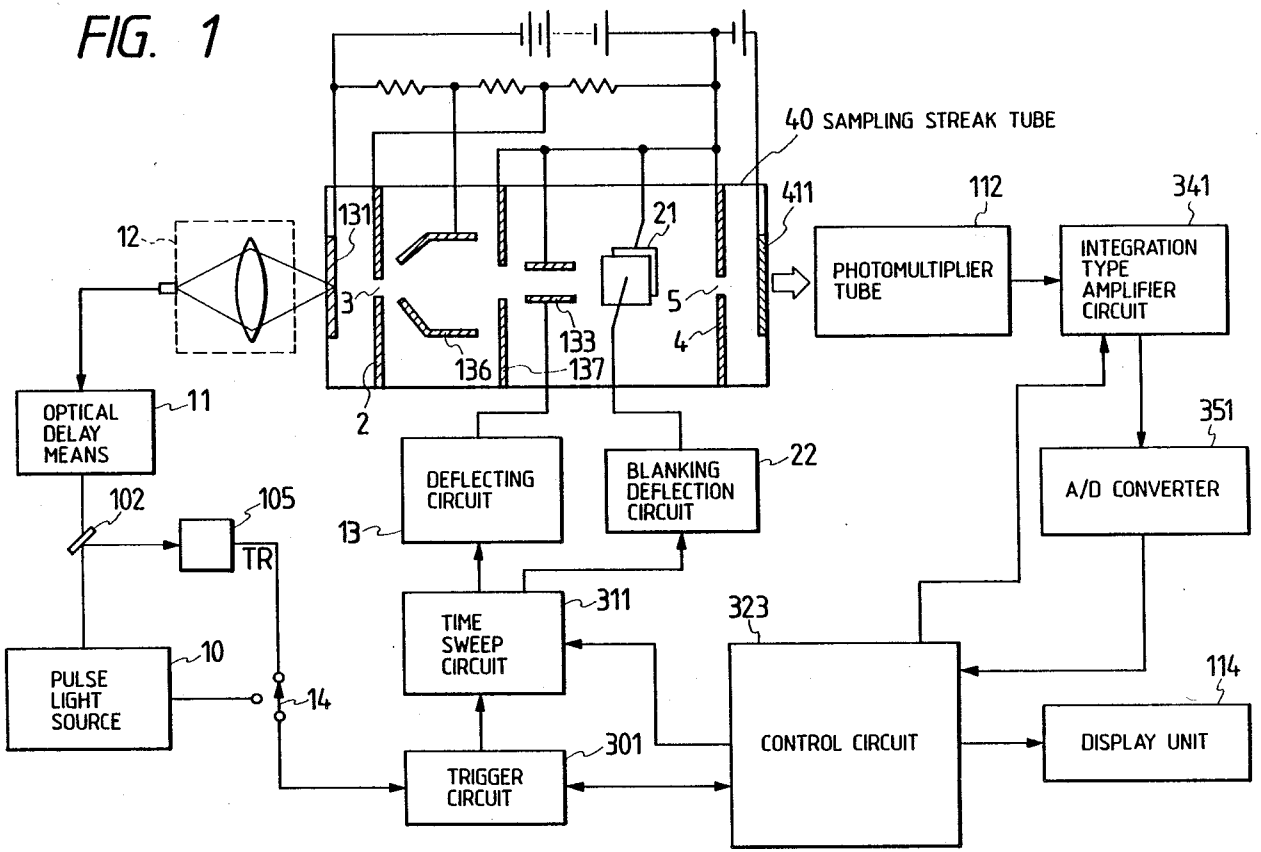
FIG. 1 is a diagram showing the arrangement of one example of an optical waveform observing apparatus according to the invention.

FIG. 1 shows the arrangement of one example of an optical waveform observing apparatus according to the present invention. In FIG. 1, parts corresponding functionally to those that have already been described with reference to FIG. 9 are designated by the same reference numerals, and the preceding description is applicable thereto.

In accordance with the invention as embodied in the optical waveform observing apparatus shown in FIG. 1, the electrical trigger signal TR provided by photodiode 105, or the drive circuit of pulse light source 10, is applied to a trigger circuit 301. Trigger circuit 301 operates to detect and determine the repetitive frequency and the number of times of rise of the electrical trigger signal TR and apply that information to a control circuit 323, and also to apply the electrical trigger signal TR to a time sweep circuit 311.

A time sweep circuit 31 operates to form a deflecting trigger signal by delaying the electrical trigger signal TR stepwise whenever the predetermined sampling operation is accomplished. The deflecting trigger signal is applied to deflecting circuit 13 and blanking deflecting circuit 22. That is, the time sweep circuit 31 unlike the time sweep circuit 107 in FIG. 9 which forms the deflecting trigger signal so that the sampling operation is carried out only once at each of the sampling times, forms the deflecting trigger signal so that the sampling operation is carried out multiple times at a sampling time.

Figure 2:
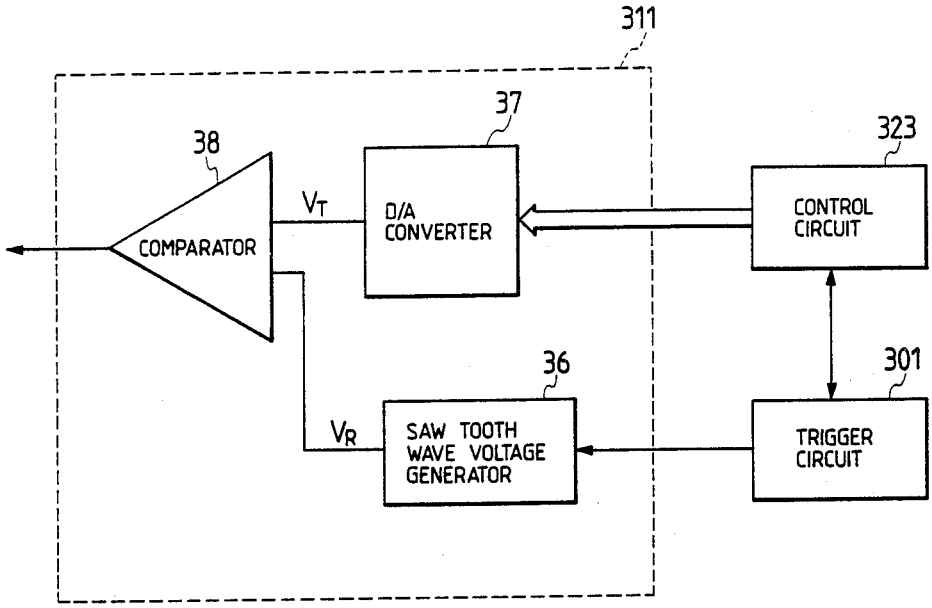
FIG. 2 is a block diagram showing the arrangement of a time sweep circuit included in the apparatus illustrated in FIG. 1.

FIG. 2 is a block diagram showing the arrangement of the time sweep circuit 31 in the apparatus of the invention. Parts (a), (b) and (c) of FIG. 3 are time charts illustrative of the operation of time sweep circuit 311.

The time sweep circuit 31 as shown in FIG. 2, comprises a saw tooth wave voltage generating circuit 36 for producing a saw tooth Wave voltage $V_R$ in synchronism With the electrical trigger signal TR outputted by a trigger circuit 30 a D/A (digital-to-analog) converter 37 for converting digital data provided by control circuit 33 into analog data to output a stepwise threshold voltage $V_T$, and a COmparator 38 for comparing the saw tooth wave voltage $V_R$ provided by the saw tooth wave voltage generating circuit 36 with the threshold voltage $V_T$ provided by D/A converter 37, and outputting a deflecting trigger signal that is delayed by a predetermined period of time from the electrical trigger signal.

The trigger circuit 30 outputs the electrical trigger signal TR having the predetermined repetitive period To as shown in part (a) of FIG. 3. The Saw tooth wave generating circuit 36 of the time sweep circuit 31, in response to the electrical trigger signal TR applied thereto, generates the saw tooth Wave voltage $V_R$, as Shown in part (b) of FIG. 3, synchronous with the electrical trigger signal TR. Trigger circuit 30 also detects and determines the repetitive frequency and number of times of rise, i.e., number of occurrences, of the electrical trigger signal and applies that information to control circuit 32. In accordance with this information, the control circuit 323 supplies to a D/A converter 37 a digital data whose value is incremented by "1" whenever the electrical trigger signal TR rises M times. The D/A converter 37 subjects the output digital data of control circuit 323 to digital-to-analog conversion, to provide the stepwise threshold voltage $V_T$ as indicated by the broken line in part (b) of FIG. 3.

The level of the threshold. voltage $V_T$ is maintained unchanged until the electrical trigger signal TR rises M times. However, it changes stepwise when the $(M+1)-$th electrical trigger signal TR is produced. A Comparator 38 compares the threshold voltage $V_T$ and the saw tooth wave voltage $V_R$ with each other and when $V_R$ is equal to $V_T$, the deflecting trigger signal is produced, as shown in the part (c) of FIG. 3.

As is shown in parts (a), (b) and (c) of FIG. 3, before the threshold voltage $V_T$ changes stepwise, i.e., at the n−th sampling time, the deflecting trigger signal is delayed by a period of time n·t from the electrical trigger signal TR. After the threshold voltage $V_T$ changes stepwise, i.e., at the (n+1)−th sampling time, the deflecting trigger signal is delayed by a period of time (n+1)·t. In the illustrated embodiment, a sampling time (e.g., the n−th sampling time) corresponds to the period of time for which the threshold voltage $V_T$ is maintained unchanged. Accordingly, for one sampling time, the time sweep circuit 31 outputs M deflecting trigger signals, that are applied to the deflecting circuit 13 and the blanking deflecting circuit 22.

At a current sampling time (e.g., the n−th sampling time), the M deflecting trigger signals provided have the same repetitive period $T_o$ as the electrical trigger signal TR. However, when the hext sampling time (e.g., the (n+1)−th sampling time) occurs with the threshold voltage $V_T$ changed stepwise, the time interval between the last deflecting trigger signal of the preceding sampling time (n−th sampling time) and the first deflecting trigger signal of the next sampling time is not $T_0$ but $T_1$ ($=T_0+t$) which is longer by the unitary delay time t.

As is apparent from the above description, the time sweep circuit 31 of the illustrated embodiment does not employ the method in which the optical waveform is observed with the same sampling sequence repeated plural times (M times) and instead employs the method in which the optical waveform is observed with only one sampling sequence having N sampling times and in order that a plurality of sampling operations (M sampling operations) are continuously carried out in one sampling time, the deflecting trigger signals are periodically changed stepwise in delay time.

Referring again to FIG. 1, in response to the above-described deflecting trigger signal from the time sweep circuit 31, a sampling streak tube 40 carries out the sampling operation a Plural times in one sampling time, and applies each of the sampling results to the photomultiplier 112, the output current of which is applied to an integration type amplifier circuit 34. The Integration type amplifier circuit 34 operates, under the control of control circuit 32, to integrate a plurality of sampling results, i.e., the output current of the photomultiplier 112, obtained in a sampling time and to convert the result of integration into voltage. The analog integration value resulting from integration of the sampling results in a sampling time by the integration type amplifier circuit 34 is converted into a digital integration value by and A/D (analog-to-digital) converter 35, the digital integration value being displayed on display unit 114.

The operation of the optical waveform observing apparatus thus organized is described next with reference to the time charts illustrated in parts (a) through (h) of FIG. 4.

When the pulse light source 10 is driven repeatedly with a predetermined frequency, incident light beams IN with a repetitive period as shown in part (a) of FIG. 4 are applied to a photocathode 131 of the sampling streak tube 40. The electrical trigger signals TR, synchronous with the incident light beams IN as shown in part (b) of FIG. 4, are applied to the trigger circuit 30. As was described above, under the control of the control circuit 32, the electrical tfigger signals TR thus applied are converted into the deflecting trigger signals TR1', TR2', TR3', . . . as shown in part (c) of FIG. 4, those signals being applied to the deflecting circuit 13 and the blanking deflecting circuit 22. In the deflecting circuit 13, deflecting voltages V, as shown in part (d) of FIG. 4, are produced in synchronism with the deflecting trigger signals TR1', TR2', TR3', . . . and applied across deflecting electrodes 133. In the blanking deflecting circuit 22, blanking deflecting voltages $V_b$ are produced in synchronism with the deflecting trigger signals, as shown in part (e) of FIG. 4, and are applied across blanking deflecting electrodes 21. As a result, in the sampling streak tube 40, the electron beams emitted from the photocathode 131 in response to the incident light beams IN are deflected in a sweep mode, and sampling waveforms P1', P2', P3', . . . shown in part (f) of FIG. 4 are extracted with the aid of a slit 5 of a sampling electrode 4.

As is apparent from comparison of part (f) of FIG. 4 with part (e) of FIG. 6, in accordance with the illustrated embodiment, the deflecting trigger signal (TR1', TR2') having the same period $T_0$ as the electrical trigger signal TR is produced plural times (M times) in a sampling time (the n−th sampling period). As a result, the sampling waveforms P1' and P2' sampled with the deflecting trigger signals TR1' and TR2' provided in the sampling time are the same parts of the waveforms of the incident light beams IN.

The same parts of the waveforms of the incident light beams IN in the sampling time are extracted as sampling waveforms (P1' and P2') repeatedly (M times), and are repeatedly detected as output current by the photomultiplier 112. The sampling results in the form of the output current of the photomultiplier 112, are integrated by the integration type amplifier circuit 34 to provide a voltage that is an analog integration value AAC shown in part (g) of FIG. 4. The integration value of the integration type amplifier circuit 34 is reset at the start of each sampling time. When the last sampling operation in the sampling time (the n−th sampling time) is accomplished, the analog integration value AAC is converted into a digital integration value DAC by the A/D converter 35, shown in part (h) of FIG. 4, which is applied to the control circuit 32. The integration type amplifier circuit 34 is then reset and the next sampling time occurs.

In the next sampling time (the (n+1)−th sampling time), as shown in part (c) of FIG. 4, the deflecting trigger signal has a delay time increased by the unitary delay time t with respect to the electrical trigger signal TR and is produced multiple times (M times). In this sampling time, the sampling waveform (P3') obtained corresponds to the part of the waveform of the incident light beam IN that is next to that corresponding to the sampling waveforms (P1', P2') in the preceding sampling time. That is, sampling waveform P3' reflects the next part of the incident light beam waveform. In the following sampling time, the following part of the waveform of the incident light beam IN is extracted repeatedly (M times) in the same manner and the sampling results are integrated by integration type amplifier circuit 34, i.e., they are processed in the same way as in the preceding sampling time.

As described above, according to the illustrated embodiment, the same part of the waveform of the incident light beam IN is repeatedly sampled, and the sampling results are integrated. Hence, the effect of the afterglow on the integration value when a sampling time is switched over to the next sampling time is substantially less than in the case where, in a sampling time, the sampling is continuously performed and integrated. That is, when, in accordance with the illustrated embodiment, the sampling is carried out M times in a sampling time, the effect of the afterglow. on the integration value is reduced to about 1/M. Further, the .afterglow equally affects the integration value in each sampling time. Accordingly, in the illustrated embodiment, the repetitive period $T_O$ of the electrical trigger signal TR can be made short, e.g., 250 nano-seconds, since it is not limited by the attenuation time of the afterglow. As a result, the total processing time can be greatly reduced.

For improvement of the observation accuracy of the apparatus of the illustrated embodiment, a phosphor screen 41 of the sampling streak tube 40 is formed by using the fluorescent material called "P-15" which has an attenuation time that is short and scarcely affected by excitation time. With respect to some of the phosphor screen, the time required for attenuation of the luminance to about 1/100 of the peak value is short, but the time required for attenuation of the luminance to 1/1000 to 1/10000 is several seconds. Further with respect to such materials, the attenuation time may be short when the excitation time is short, but it is long when the excitation time is long. With such fluorescent materials, it is difficult to suppress the effect of the afterglow when a sampling time is switched over to the following sampling time. Accordingly, in the illustrated embodiment, the phosphor screen 41 of the sampling streak tube 40 is formed by using the P-15 fluorescent material which is free from the above-described difficulty, so that the effect of the afterglow is decreased whenever a new improved.

In summary, in accordance with the waveform observing apparatus of the invention, for the sampling operation of the sampling streak tube, first the electrical trigger signal is produced in synchronism with the repetitive frequency of the incident light beam. The electrical trigger signal is applied to the time sweep circuit where it is delayed stepwise whenever the sampling operation is performed a predetermined number of times, thus providing the deflecting trigger signal. That is, the deflecting trigger signal is produced the same number of times and the deflecting trigger signals thus produced are equal in delay time. In synchronism with the deflecting trigger signal, the delay time of which is changed stepwise by the time sweep means, the deflecting means deflects the electron beam in the sampling streak tube in the sweep mode. As a result, in the sampling steak tube, the same part of the waveform of the incident light beam is sampled continuously in synchronism with the deflecting trigger signals that are provided the predetermined number of times. The sampling results are integrated by the integration means, thus providing the result of observation of that part .of the waveform. Thereafter, the delay time of the deflecting trigger signal is changed stepwise and the next part of the waveform of the incident light beam is similarly sampled the predetermined number of times, so that the result of observation of the next part of the waveform is provided. As described above, the same part of the waveform of the incident light beam is sampled the predetermined number of times, and the integration of the sampling results is employed as the results of observation of that part of the waveform. Accordingly, the effect of afterglow on the results of observation when the next sampling time occurs is small in proportion to the number of times the waveform is sampled and its effect on the total result of observation is minimized. Thus, even if the sampling repetitive period is reduced, the waveform observation accuracy can be maintained as required.

Thus, in accordance with the optical waveform observing apparatus of the invention, the electrical trigger signal is changed stepwise whenever the sampling operation is carried out a predetermined number of times, and the results of the sampling operations of the predetermined number of times are integrated. Therefore, the effect of the afterglow on the integration value when a sampling operation is switched over to the next sampling operation is small in proportion to the number of times the sampling operation is carried out, in comparison with the effect of the afterglow on the total integration value. As a result, the optical waveform can be observed at a high speed and with high accuracy being free from the attenuation time of the afterglow of the phosphor screen.

Thus, it is intended that the present invention cover the modifications and the variations of this invention provided they come within the scope of the appended claims and their equivalents.

What is claimed is:

1. Optical waveform observing apparatus including a sampling streak tube for observing a waveform of an incident light beam having a repetitive frequency, the streak tube including means responsive to a repetitive deflecting trigger signal for deflecting in a sweep mode an electron beam corresponding to the incident light beam so that the electron beam can be sampled, the apparatus comprising:

electrical trigger signal means for generating an electrical trigger signal in synchronism with the repetitive frequency of said incident light beam;

time sweep means, operatively coupled to said trigger signal means, for stepwise delaying by a predetermined time period said electrical trigger signal to provide said deflecting trigger signal, said time sweep means effecting the stepwise delay in said deflecting trigger signal whenever the sampling operation is carried out a predetermined number of times; and integration means for integrating sampling results, outputted by said streak tube, of the sampling operations carried out the predetermined number of times and providing a corresponding integrated sampling results.

2. The optical waveform observing apparatus of claim 1, wherein said trigger signal means includes means for counting a number of occurrences of said electrical trigger signal; and said apparatus further includes control circuit means, operatively coupled to said trigger signal means and said time sweep means and responsive to electrical trigger signal occurrence data provided by said trigger signal means, for generating a delay control signal, said time sweep circuit being responsive to said delay control signal to effect the stepwise delay in said deflecting trigger signal.

3. The optical waveform observing apparatus of claim 2, wherein said time sweep means includes:

comparator means having a first and a second input;

saw tooth wave voltage generating means for repetitively generating a saw tooth wave voltage in synchronism with said electrical trigger signal, said saw tooth wave voltage being applied to said first input of said comparator means;

said second input of said comparator means receiving said delay control signal in the form of a threshold voltage having a magnitude that is stepwise increased whenever said electrical trigger signal has been generated the predetermined number of times; and said comparator means providing said deflecting trigger signal each time the voltage applied to said first input of said comparator means at least equals the voltage applied to said second input of said comparator means.

4. The optical waveform observing apparatus of claim 3, wherein said control circuit means generates said delay control signal as a digital data value and increments the digital data valued by "1" each time said electrical trigger signal is generated the predetermined number of times; and said time sweep means further includes digital-to-analog converter means, coupled between said control circuit means and said second input of said comparator means , for providing said threshold voltage in response to the digital data value generated by said control circuit means, such that each time said digital data value is incremented, the deflecting trigger signal generated by said comparator means in stepwise delayed.

5. The optical waveform observing apparatus of claim 4, wherein said integration means is controlled by said control circuit means to integrate the sampling results of the predetermined number of sampling operations occurring during a sampling time and then to be reset so that said integration means can begin integrating the sampling results of the predetermined number of sampling operations occurring in a next sampling time.

6. The optical waveform observing apparatus of claim 2, wherein said integration means is controlled by said control circuit means to integrate the sampling results of the predetermined number of sampling operations occurring during a sampling time and then to be reset so that said integration means can begin integrating the sampling results of the predetermined number of sampling operations occurring in a next sampling time.

7. The optical waveform observing apparatus of claim 6, further including analog-to-digital converter means, operatively coupled to receive the integrated sampling result provided by said integration means for each sampling time, for generating in response thereto a digital integration value;

said control circuit means being operatively coupled to said analog-to-digital converter means to receive each digital integration value; and display means, coupled to said control circuit means, to receive for display the digital integration values generated by said analog-to-digital converter means.

8. The optical waveform observing apparatus of claim 7, further including photomultiplying means, responsive to a luminance distribution generated by said streak tube and corresponding to the sampled electron beam, for providing the sampling results outputted by said streak tube as an electrical output current; and wherein said integration means being provided as an integrating type amplifier circuit operatively coupled to receive the output current of said photomultiplying means as the sampling results to be integrated.

9. The optical waveform observing apparatus of claim 1, wherein said streak tube includes a phosphor screen to which the sampled electron beam is applied; and said phosphor screen is formed with a P-15 fluorescent material.

10. An optical waveform observing system, comprising:

a sampling streak tube for observing a waveform of an incident light beam having a repetitive frequency, said streak tube including means responsive to a repetitive deflecting trigger signal for deflecting in a sweep mode an electron beam corresponding to the incident light beam so that the electron beam can be sampled;

electrical trigger signal means for generating an electrical trigger signal in synchronism with the repetitive frequency of said incident light beam;

time sweep means, operatively coupled to said trigger signal means, for stepwise delaying by a predetermined time period said electrical trigger signal to provide said deflecting trigger signal, said time sweep means effecting the stepwise delay in said deflecting trigger signal whenever the sampling operation is carried out a predetermined number of times; and integration means for integrating sampling results, outputted by said streak tube, of the sampling operations carried out the predetermined number of times and providing a corresponding integrated sampling result.

11. The optical waveform observing system of claim 10, wherein said trigger signal means includes means for counting a number of occurrences of said electrical trigger signal; and said system further including control circuit means, operatively coupled to said trigger signal means and said time sweep means and responsive to electrical trigger signal occurrence data provided by said trigger signal means, for generating a delay control signal, said time sweep circuit being responsive to said delay control signal to effect the stepwise delay in said deflecting trigger signal.

12. The optical waveform observing system of claim 11, said time sweep means including:

comparator means having a first and a second input;

saw tooth wave voltage generating means for repetitively generating a saw tooth wave voltage in synchronism with said electrical trigger signal, said saw tooth wave voltage being applied to said first input of said comparator means;

said second input of said comparator means said delay control signal in the form of a threshold voltage having a magnitude that is stepwise increased whenever said electrical trigger signal has been generated the predetermined number of times; and said comparator means providing said deflecting trigger signal each time the voltage applied to said first input of said comparator means at least equals the voltage applied to said second input of said comparator means.

13. The optical waveform observing system of claim 12, wherein said control circuit means generates said delay control signal as a digital data value and increments the digital data value by "1" each time said electrical trigger signal is generated the predetermined number of times; and said time sweep means further includes digital-to-analog converter means, coupled between said control circuit means and said second input of said comparator means input, for providing said threshold voltage in response to the digital data value generated by said control circuit means, such that each time said digital data value is incremented, the deflecting trigger signal generated by said comparator means is stepwise delayed.

14. The optical waveform observing system of claim 13, wherein said integration means is controlled by said control circuit means to integrate the sampling results of the predetermined number of sampling operations occurring during a sampling time and then to be reset so that said integration means can begin integrating the sampling results of the predetermined number of sampling operations occurring in a next sampling time.

15. The optical waveform observing system of claim 11, wherein said integration means is controlled by said control circuit means to integrate the sampling results of the predetermined number of sampling operations occurring during a sampling time and then to be reset so that said integration means can begin integrating the sampling results of the predetermined number of sampling operations occurring in a next sampling time.

16. The optical waveform observing system of claim 15, further including analog-to-digital converter means, operatively coupled to receive the integrated sampling result provided by said integration means for each sampling time, for generating in response thereto a digital integration value;

said control circuit means being operatively coupled to said analog-to-digital converter means to receive each digital integration value; and display means, coupled to said control circuit means, to receive for display the digital integration values generated by said analog-to-digital converter means.

17. The optical waveform observing system of claim 16, further including photomultiplying means, responsive to a luminance distribution generated by said streak tube and corresponding to the sampled electron beam, for providing the sampling results outputted by said streak tube as an electrical output current; and wherein said integration means being provided as an integrating type amplifier circuit operatively coupled to receive the output current of said photomultiplying means as the sampling results to be integrated.

18. The optical waveform observing system of claim 10, said steak tube including a phosphor screen to which the sampled electron beam is applied; and said phosphor screen being formed with a P-15 fluorescent material.

* * * * *